US007917046B2

(12) United States Patent
Kubo

(10) Patent No.: US 7,917,046 B2
(45) Date of Patent: Mar. 29, 2011

(54) DEVELOPMENT DEVICE AND IMAGE FORMING APPARATUS PROVIDED THEREWITH

(75) Inventor: Norio Kubo, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 406 days.

(21) Appl. No.: 12/213,573

(22) Filed: Jun. 20, 2008

(65) Prior Publication Data

US 2009/0003855 A1 Jan. 1, 2009

(30) Foreign Application Priority Data

Jun. 29, 2007 (JP) ..... 2007-171342

(51) Int. Cl.

| | |
|---|---|
| ***G03G 15/00*** | (2006.01) |
| ***G03G 15/06*** | (2006.01) |
| ***G03G 21/20*** | (2006.01) |
| ***G03G 15/09*** | (2006.01) |
| ***G03G 15/08*** | (2006.01) |

(52) U.S. Cl. ..... 399/44; 399/55; 399/88; 399/270; 399/281

(58) Field of Classification Search ..... 399/44, 399/55, 235, 270, 285, 88, 281
See application file for complete search history.

(56) References Cited

U.S. PATENT DOCUMENTS

| | | | | |
|---|---|---|---|---|
| 7,221,881 | B2 * | 5/2007 | Do | 399/44 |
| 2006/0067719 | A1 * | 3/2006 | Karasawa | 399/44 |
| 2007/0053705 | A1 * | 3/2007 | Takahashi | 399/27 |
| 2007/0286625 | A1 * | 12/2007 | Fukuyama et al. | 399/56 |
| 2007/0286647 | A1 * | 12/2007 | Sano et al. | 399/281 |
| 2008/0118279 | A1 * | 5/2008 | Maeyama et al. | 399/281 |

FOREIGN PATENT DOCUMENTS

| | | |
|---|---|---|
| JP | 2001-134066 | 5/2001 |

* cited by examiner

*Primary Examiner* — David M Gray
*Assistant Examiner* — Francis Gray
(74) *Attorney, Agent, or Firm* — Smith, Gambrell & Russell, LLP

(57) ABSTRACT

The first direct-current bias power supply applying the first direct-current bias Vdc1 and the first alternating-current bias power supply applying the first alternating-current bias Vac1 are connected to a development roller. The second direct-current bias power supply applying the second direct-current bias Vdc2 and the second alternating-current bias power supply applying the second alternating-current bias Vac2 are connected to a magnetic roller. The peak-to-peak value Vpp of the first alternating-current bias Vac1 applied to the development roller remains the same, and the second alternating-current bias Vac2 that is in phase with the first alternating-current bias Vac1 and that has a peak-to-peak value of a predetermined value or above is applied to the magnetic roller. Thus, the potential difference between the peak voltage of the development bias on the opposite polarity side to the polarity of the toner and the peak voltage of a supply bias is set at a predetermined value or below.

15 Claims, 5 Drawing Sheets

DEVELOPMENT DEVICE AND IMAGE FORMING APPARATUS PROVIDED THEREWITH

This application is based on Japanese Patent Application No. 2007-171342 filed on Jun. 29, 2007, the contents of which are hereby incorporated by reference.

BACKGROUND OF THE INVENTION

1. Field of the Invention

The present invention relates to a development device incorporated in an image forming apparatus such as a copying machine, a facsimile machine or a printer and to an image forming apparatus including such a development device. More particularly, the invention relates to a method for controlling the driving of a development device that employs a touchdown development method in which a two-component developer composed of a magnetic carrier and toner is used, and charged toner on a development roller is only retained and then an electrostatic latent image on an image carrying member is developed in a contact or noncontact manner.

2. Description of the Related Art

Conventionally, the following two methods are known as dry toner development methods for use in an image forming apparatus employing an electrophotographic process: one is a one-component development method in which no carriers are used; and the other is a two-component development method in which a two-component developer whereby non-magnetic toner is electrically charged with a magnetic carrier is used, and an electrostatic latent image on an electrostatic-latent-image carrying member (a photoconductor) is developed with a magnetic brush composed of the toner and the carrier formed on a development roller.

Since an electrostatic latent image on an electrostatic-latent-image carrying member is not disturbed by a magnetic brush, the one-component development method is suitable in seeking higher image quality. In the one-component development method, however, toner is electrically charged with a charge roller, and the thickness of a layer on a development roller is restricted by an elasticity-restriction blade, with the result that an additive for the toner adheres to the charge roller and this reduces charging capacity. Thus, it is difficult to stably maintain the amount of charge on toner. Moreover, the toner may adhere to the restriction blade to form an uneven toner layer on the development roller, and this results in degraded image quality.

In the case of color printing where color images are superimposed, since toner is required to be transparent, it is necessary to use non-magnetic toner. Thus, full-color image forming apparatuses frequently employ the two-component development method in which toner containing no carrier components is only charged and transferred. In the two-component development method, the amount of charge on toner can be stably maintained for a long period, and this is suitable in obtaining a longer life of toner. However, the two-component development method is disadvantageous in terms of image quality due to adverse effects of the magnetic brush.

One proposed solution to these problems is to employ a hybrid (touchdown) development method in which when developer is transferred with a magnetic roller onto a development roller that is arranged so as not to make contact with an electrostatic-latent-image carrying member (a photoconductor), non-magnetic toner is only transferred, while magnetic carrier is being left on the magnetic roller, onto the development roller to form a thin toner layer, and then the toner is adhered to a latent image on the electrostatic-latent-image carrying member (the photoconductor) by an alternating-current electric field.

With this technology, since the two-component development method described above is adopted in consideration of a longer life of toner in the area where the toner is electrically charged and the one-component development method in which the toner is only adhered to a photoconductor in a contact or noncontact manner in order to achieve higher image quality is thereafter adopted in the area where development is performed, it is possible to take advantage of both the one-component development method and the two-component development method. Thus, the hybrid (touchdown) development method is the most suitable for full-color image forming apparatuses required to have higher image quality and a longer life.

Disadvantageously, however, even with the touchdown development method, since the area exists in which the two-component development method where the magnetic carrier is used is adopted, when the resistance of the developer decreases under high-humidity conditions, the carrier deteriorates due to prolonged driving of the development device or other problems arise, the carrier is transferred through the development roller to the electrostatic-latent-image carrying member, with the result that white or black spots appear in a printed image; this so-called carrier development is more likely to occur. The carrier development is more likely to occur particularly in a solid image or a half-tone portion of an image; this results in an extremely serious problem from an appearance standpoint and a tactile standpoint.

To overcome these problems, various methods are proposed that prevent the occurrence of the carrier development. For example, patent document 1 (JP-A-2001-134066) discloses an image forming apparatus employing a two-component development method in which the carrier development is prevented by varying at least one of three factors, namely, the rotation speed of a developer carrying member (a development roller), the magnitude of the direct-current component of a development bias and the surface potential of a photoconductor.

According to the method disclosed in patent document 1, however, since it is necessary to decrease the magnitude of the direct-current component of the development bias, the surface potential of the photoconductor or to increase the rotation speed of the development roller under conditions in which the carrier development is more likely to occur, the occurrence of the carrier development can be prevented but the development performance may be degraded. Thus, it is likely that stable images cannot be obtained. In the method disclosed in patent document 1, the movement of the carrier from the development roller to the photoconductor is prevented in the two-component development method. Hence, it is not possible to apply the method disclosed in patent document 1 as it is to the touchdown development method, where the movement of the carrier from the magnetic roller to the development roller needs to be prevented.

SUMMARY OF THE INVENTION

An object of the present invention is to provide a development device employing a touchdown development method that prevents not only the occurrence of carrier development for a long period but also degraded image quality, and is to provide an image forming apparatus incorporating such a development device.

To achieve the above object, according to the present invention, a development device is provided that includes: a toner carrying member that is disposed opposite an image carrying member and that adheres, by receiving a development bias composed of a first direct-current bias and a first alternating-current bias, toner to the surface of the image carrying member to develop an electrostatic latent image; and a toner supply member receiving a supply bias composed of a second direct-current bias higher on the same polarity side as the polarity of the toner than the first direct-current bias and a second alternating-current bias having a peak-to-peak value lower than that of the first alternating-current bias and forming with a magnetic brush a thin toner layer on the toner carrying member. Here, a potential difference between a peak voltage of the development bias on the opposite polarity side to the polarity of the toner and a peak voltage of the supply bias is set at a predetermined value or below, and a two-component developer including at least a carrier and the toner is used.

With this construction, when the toner is supplied to the toner carrying member from the toner supply member, the toner is not removed more than necessary, and this prevents the carrier on the toner supply member from having the opposite charges. Thus, it is possible to effectively prevent the carrier from moving to the toner carrying member and the carrier development on an outputted image.

In the development device constructed as described above and according to the invention, a potential difference between the first direct-current bias and the second direct-current bias may remain unchanged, and the potential difference between the peak voltage of the development bias on the opposite polarity side to the polarity of the toner and the peak voltage of the supply bias may be set at a predetermined value or below.

With this construction, it is possible not only to effectively prevent the carrier from moving to the toner carrying member and the carrier development on an outputted image, but also to keep constant the thickness of a thin toner layer formed on the toner carrying member.

In the development device constructed as described above and according to the invention, the peak-to-peak value of the first alternating-current bias may be maintained at a predetermined value or above, and the potential difference between the peak voltage of the development bias on the opposite polarity side to the polarity of the toner and the peak voltage of the supply bias may be set at a predetermined value or below.

With this construction, it is possible not only to effectively prevent the carrier from moving to the toner carrying member and the carrier development on an outputted image, but also to prevent degraded development performance on an electrostatic latent image on the image carrying member.

In the development device constructed as described above and according to the invention, when the second alternating-current bias in phase with the first alternating-current bias is applied to the toner supply member, the peak-to-peak value of the first alternating-current bias may remain unchanged, and the peak-to-peak value of the second alternating-current bias may be set at a predetermined value or above.

With this construction, it is possible not only to effectively prevent the carrier development, but also to maintain the development performance on an electrostatic latent image on the image carrying member.

In the development device constructed as described above and according to the invention, when the second alternating-current bias in opposite phase to the first alternating-current bias is applied to the toner supply member, the peak-to-peak value of the first alternating-current bias may remain unchanged, and the peak-to-peak value of the second alternating-current bias may be set at a predetermined value or below.

With this construction, it is possible not only to effectively prevent the carrier development, but also to maintain the development performance on an electrostatic latent image on the image carrying member.

According to the present invention, an image forming apparatus is provided that includes: the development device described above; a temperature detection device detecting a temperature inside the image forming apparatus; a humidity detection device detecting a humidity inside or outside the image forming apparatus; and a control device determining, according to the temperature and the humidity detected by the temperature detection device and the humidity detection device, whether the second alternating-current bias needs to be applied and the peak-to-peak value of the second alternating-current bias applied.

With this construction, in hot and humid conditions where the carrier development is more likely to occur, the occurrence of the carrier development can be further effectively prevented by applying to the toner supply member an appropriate second alternating-current bias corresponding to the temperature and humidity; in conditions where no carrier development occurs, the unnecessary control can be restricted.

According to the present invention, an image forming apparatus is provided that includes: the development device described above; a measuring device measuring an accumulated drive time of the development device; and a control device determining, according to the accumulated drive time measured by the measuring device, whether the second alternating-current bias needs to be applied and the peak-to-peak value of the second alternating-current bias applied.

With this construction, in conditions where the carrier development is more likely to occur due to prolonged accumulated drive time, the occurrence of the carrier development can be prevented by applying to the toner supply member an appropriate second alternating-current bias corresponding to the accumulated drive time; in conditions where no carrier development occurs, the unnecessary control can be restricted.

DESCRIPTION OF PREFERRED EMBODIMENTS

Figure 1:
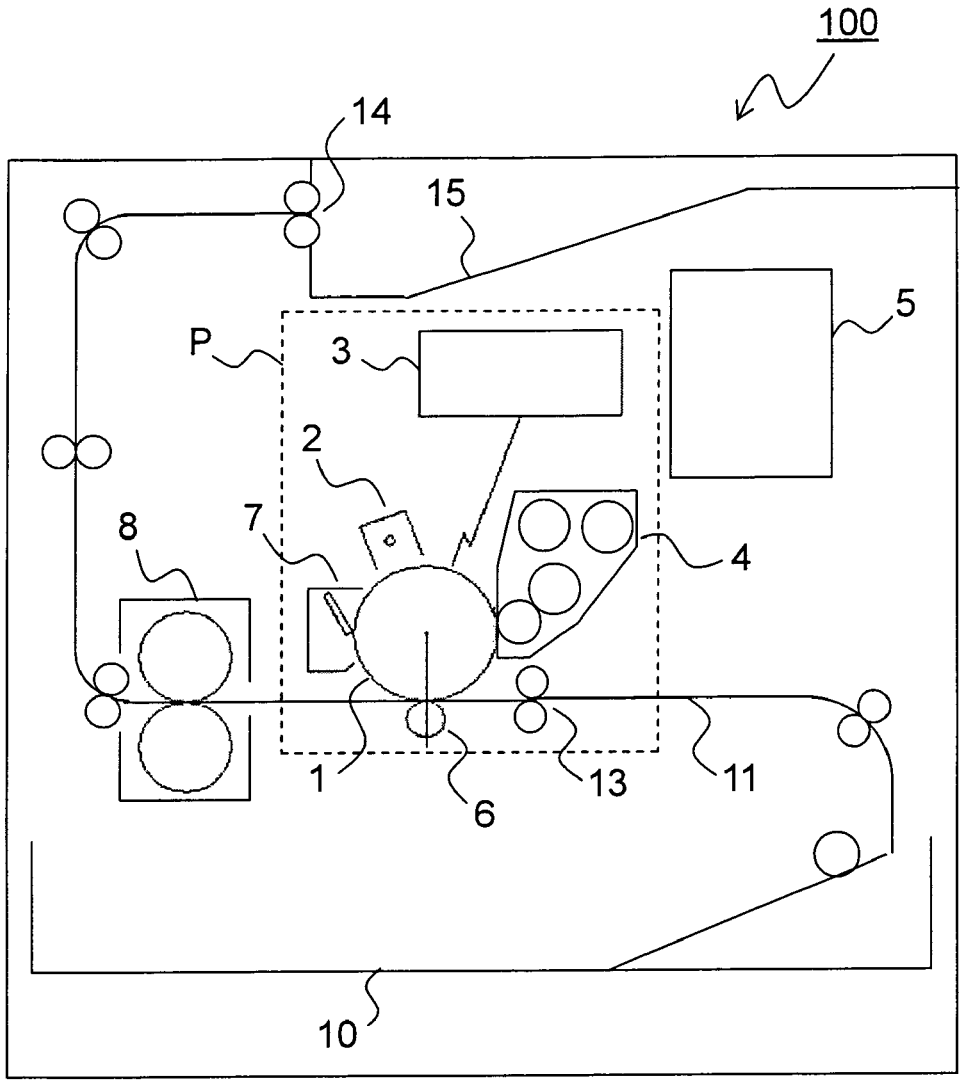
FIG. 1 is a schematic diagram showing the overall construction of an image forming apparatus incorporating a development device according to the present invention.

Hereinafter, embodiments of the present invention will be described with reference to the accompanying drawings. FIG. 1 shows an image forming apparatus (for example, a printer)

100 incorporating a development device according to the invention. In the image forming apparatus 100, when a copying operation is performed, an electrostatic latent image based on original image data transmitted from an unillustrated personal computer (PC) is formed in an image forming section P within the main body of the apparatus, and then toner is adhered to the electrostatic latent image by a development device 4 to form a toner image. The toner is supplied to the development device 4 from a toner container 5. In the image forming apparatus 100, an image forming process is performed on a photoconductor drum 1 while the photoconductor drum 1 is rotated in a clockwise direction as seen in FIG. 1.

In the image forming section P, there are arranged a charger 2, an exposure unit 3, the development device 4, a transfer roller 6, a cleaning device 7 and a charge eliminator (unillustrated) along the direction (clockwise direction) of rotation of the photoconductor drum 1. The photoconductor drum 1, for example, is formed by laying a photoconductive layer on an aluminum drum; the surface of the photoconductor drum 1 is electrically charged with the charger 2. On the area where a laser beam is received from the exposure unit 3, which will be described later, an electrostatic latent image is formed by reducing charges. Examples of the photoconductor drum 1 include an inorganic photoconductor made of selenium, amorphous silicon or the like and an organic photoconductor in which a single photoconductive layer or photoconductive layers containing a charge-generating agent, a charge-transporting agent, a binder resin and the like are formed on a conductive base member.

The charger 2 serves to evenly charge the surface of the photoconductor drum 1. As the charger 2, a scorotron discharger, for example, is used that produces a corona discharge by applying a high voltage to a thin wire through a grid electrode. Instead of the scorotron discharger, a contact-type charging device may be used that applies voltage with charging members such as a charging roller and a charging brush in contact with the surface of the photoconductor. The exposure unit 3 shines, based on image data, a light beam (for example, a laser beam) on the photoconductor drum 1 to form an electrostatic latent image on the photoconductor drum 1.

The development device 4 adheres toner to an electrostatic latent image on the photoconductor drum 1 to form a toner image. Here, a two-component developer composed of a magnetic carrier and toner is stored in the development device 4. The development device 4 will be described in detail later. The transfer roller 6 transfers, without disturbing a toner image formed on the surface of the photoconductor drum 1, the toner image to a sheet of paper that is conveyed through a sheet conveying passage 11. The cleaning device 7 is provided with a cleaning roller, a blade member and the like that make line contact with the photoconductor drum 1 in the longitudinal direction thereof. After the toner image is transferred to a recording medium, the cleaning device 7 removes the toner (residual toner) left on the surface of the photoconductor drum 1.

The exposure unit 3 shines a laser beam (a light ray) onto the photoconductor drum 1 based on previously received image data, and thus an electrostatic latent image based on the received image data is formed on the surface of the photoconductor drum 1. Thereafter, the development device 4 adheres the toner to the electrostatic latent image to form a toner image.

Toward the photoconductor drum 1, on which the toner image is formed as described above, a sheet of paper is conveyed from a sheet housing section 10 via the sheet conveying passage 11 and a pair of resist rollers 13 to the image forming section P, and in the image forming section P, the toner image on the surface of the photoconductor drum 1 is transferred to the sheet by the transfer roller 6. Then, the sheet to which the toner image is transferred is separated from the photoconductor drum 1, and is conveyed to a fixing section 7 where the toner image is fixed. The sheet that is passed through the fixing section 7 is ejected via a pair of ejection rollers 14 into an ejection section 15.

Figure 2:
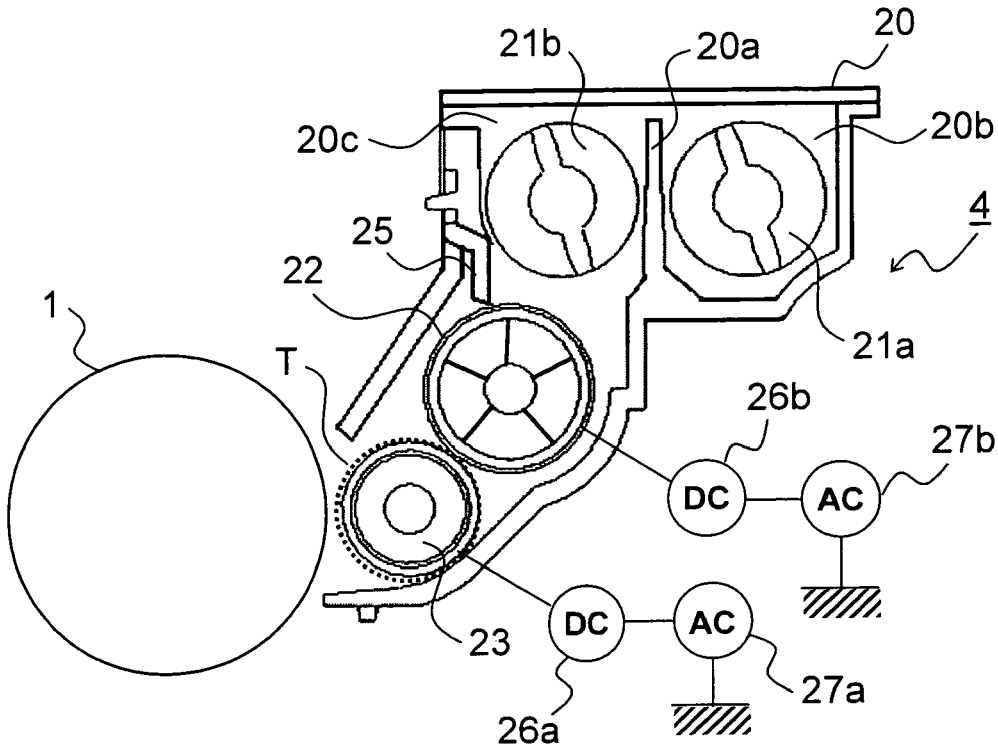
FIG. 2 is a side cross-sectional view showing the construction of the development device according to the invention.

FIG. 2 is a side cross-sectional view showing the construction of the development device according to the invention. As shown in FIG. 2, the development device 4 is provided with a development container 20 that stores a two-component developer (hereinafter, simply referred to as "a developer"). The development container 20 is divided by a dividing wall 20*a* into first and second agitation compartments 20*b* and 20*c*. In the first and second agitation compartments 20*b* and 20*c*, first and second agitation screws 21*a* and 21*b* are rotatably arranged that mix, with a carrier, toner supplied from the toner container 5 (see FIG. 1) and agitate the mixture and charge the toner.

The developer is agitated by the first and second agitation screws 21*a* and 21*b* so as to be conveyed in an axial direction, and circulates between the first and second agitation compartments 20*b* and 20*c* through a developer passage (unillustrated) formed in the dividing wall 20*a*. In the illustrated example, the development container 20 extends obliquely downward to the left; inside the development container 20, a magnetic roller (a toner feed member) 22 is disposed below the second agitation screw 21*b*; and a development roller (a toner carrying member) 23 is disposed obliquely downward to the left from the magnetic roller 22 so that the development roller 23 is disposed opposite the magnetic roller 22. The development roller 23 is disposed opposite the photoconductor drum 1 on the opening side (on the left side of FIG. 2) of the development container 20; the magnetic roller 22 and the development roller 23 rotate in the counter clockwise direction as seen in the figure.

In the development container 20, a toner sensor (unillustrated) is disposed opposite the first agitation screw 21*a*; toner is fed from the toner container 5 into the development container 20 via a toner feed inlet (unillustrated) according to the concentration of toner detected by the toner sensor.

The magnetic roller 22 is composed of a non-magnetic rotation sleeve and a fixed magnet roller member having a plurality of magnetic poles (here, five poles) contained in the rotation sleeve. The development roller 23 is formed by a non-magnetic development sleeve. The magnetic roller 22 and the development roller 23 are located opposite each other at an opposing position with a predetermined gap left therebetween.

The development container 20 is provided with an ear cutting blade 25 that is attached along the longitudinal direction (a front-to-back direction of the plane of FIG. 2) of the magnetic roller 22. The ear cutting blade 25 is disposed upstream of the opposing position where the development roller 23 and the magnetic roller 22 are located opposite each other, as seen in the direction of rotation of the magnetic roller 22 (in the counter clockwise direction as seen in the figure). A narrow gap is formed between the edge of the ear cutting blade 25 and the surface of the magnetic roller 22.

Attached to the development roller 23 are a first direct-current bias power supply 26*a* that applies a first direct-current bias (Vdc1) and a first alternating-current bias power supply 27*a* that applies a first alternating-current bias (Vac1). Attached to the magnetic roller 22 are a second direct-current bias power supply 26*b* that applies a second direct-current bias (Vdc2) and a second alternating-current bias power supply 27*b* that applies a second alternating-current bias (Vac2).

As described previously, the developer is agitated and circulated inside the development container 20 by the first and second agitation screws 21*a* and 21*b* to charge toner, and is conveyed to the magnetic roller 22 by the second agitation screw 21*b*. A magnetic brush (unillustrated) is then formed on the magnetic roller 22. The thickness of the layer of the magnetic brush is restricted by the ear cutting blade 25, and a thin toner layer T is formed on the development roller 23 by the potential difference and magnetic field between the magnetic roller 22 and the development roller 23. An electrostatic latent image on the photoconductor drum 1 is then developed by this thin toner layer T.

Figure 3A:
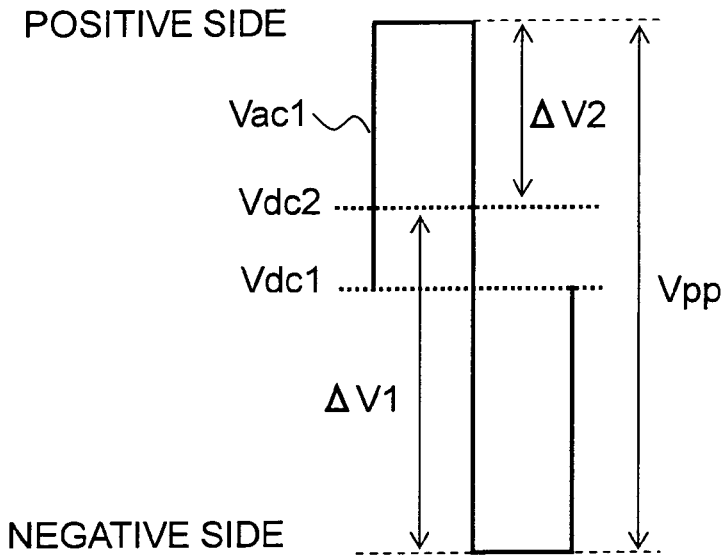
FIGS. 3A and 3B are diagrams showing the relationship between direct-current biases and alternating-current biases applied to a magnetic roller and a development roller.
Figure 3B:
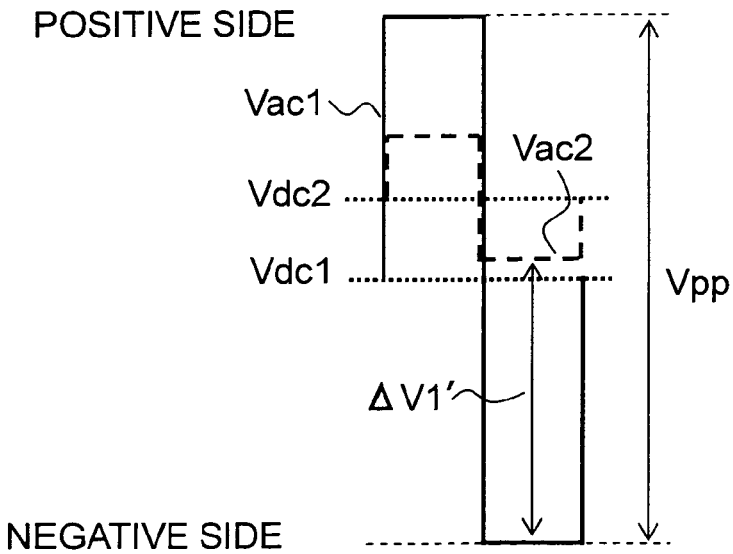

FIGS. 3A and 3B are diagrams in which the relationship between biases applied to the magnetic roller 22 and the development roller 23 in the development device of the present invention is compared with that in a conventional development device. With reference to FIGS. 2, 3A and 3B, the setting of the biases applied to the development device of the invention will be described. Here, a description will be given of a case where toner that is positively charged is used.

As shown in FIG. 3A, a development bias applied to the development roller 23 is obtained by superimposing the first direct-current bias Vdc1 on the first alternating-current bias Vac1, with the result that the voltage at the center of the peak-to-peak amplitude of the alternating-current waveform is shifted from 0 V to a positive voltage level. In this example, no alternating-current bias is applied to the magnetic roller 22, and the second direct-current bias Vdc2, which is positively higher than the first direct-current bias Vdc1, is only applied to the magnetic roller 22. The amount of toner saturated in the thin toner layer T is basically determined by the potential difference between the first direct-current bias Vdc1 and the second direct-current bias Vdc2 (supply biases). In a case where the thickness of the thin toner layer T is too small, when high-density images are continuously formed, the toner density response to the high-density images is degraded. Thus, inconsistencies in image density are more likely to occur. In contrast, in a case where the thickness of the thin toner layer T is too large, ghost images or the scattering of toner particularly tends to occur.

The supply of toner from the magnetic roller 22 to the development roller 23 and the recovery of toner from the development roller 23 to the magnetic roller 22 are controlled by the first alternating-current bias Vac1 applied to the development roller 23. Specifically, when the first alternating-current bias Vac1 is negatively higher in potential than the second direct-current bias Vdc2 applied to the magnetic roller 22, the toner is transferred to the development roller 23; when the first alternating-current bias Vac1 is positively higher in potential than the second direct-current bias Vdc2, the toner is removed from the development roller 23. Thus, the amount of toner supplied to the development roller 23 is determined by the potential difference ΔV1 between the negative peak value of the first alternating-current bias Vac1 and the second direct-current bias Vdc2; the amount of toner removed from the development roller 23 is determined by the potential difference ΔV2 between the positive peak value of the first alternating-current bias Vac1 and the second direct-current bias Vdc2.

In a case where the resistance of the developer is decreased in a hot and humid environment, toner is removed from the magnetic brush (carrier) between the magnetic roller 22 and the development roller 23, and immediately after the toner is transferred to the surface of the development roller 23, negative charges (having the opposite polarity to that of the toner) carried by the carrier are dissipated through the magnetic roller 22. The resulting current causes the carrier to have positive charges with the opposite polarity (the same polarity as that of the toner), and thus the carrier is moved to the development roller 23 similarly to the toner. Furthermore, the carrier is moved to the photoconductor drum 1, and this results in the carrier development. This phenomenon is also more likely to occur when the coating agent of the carrier is removed due to prolonged driving of the development device and thus the resistance of the carrier is decreased.

To prevent such carrier development, it is important not to remove the toner from the magnetic brush more than necessary when the toner is supplied to the development roller 23. Since the amount of toner supplied to the development roller 23 is determined by the potential difference ΔV1 as described above, the bias is adjusted such that the potential difference ΔV1 is decreased. However, simply decreasing the peak-to-peak value (potential difference between the positive potential and the negative potential) Vpp of the first alternating-current bias Vac1 causes reduction in the potential difference between the development roller 23 and the photoconductor drum 1, and this leads to decreased development performance.

To overcome this problem, according to the present invention, as shown in FIG. 3B, the peak-to-peak value Vpp of the first alternating-current bias Vac1 applied to the development roller 23 remains the same, and a supply bias obtained by superimposing on the second direct-current bias Vdc2 the second alternating-current bias Vac2 (indicated by a broken line in the figure) that is in phase with the first alternating-current bias Vac1 and that has a peak-to-peak value lower than the first alternating-current bias Vac1 is applied to the magnetic roller 22. In this way, the potential difference ΔV1 between the negative peak values of the development bias and the supply bias is reduced to a potential difference ΔV1'. Thus, the toner is not excessively removed from the magnetic roller 22, and this prevents the carrier on the magnetic roller 22 from having the opposite charges (positive charges). Hence, it is possible to effectively prevent the carrier from moving to the development roller 23. Since the peak-to-peak value Vpp is not decreased, the development performance can be maintained. Moreover, the potential difference between the first direct-current bias Vdc1 and the second direct-current bias Vdc2 remains unchanged, and this makes it possible to keep constant the thickness of the thin toner layer T formed on the development roller 23. The peak-to-peak value of the second alternating-current bias Vac2 is set at a predetermined value or above at which the potential difference ΔV1' becomes equal to or less than the potential difference that causes no carrier development.

Figure 4A:
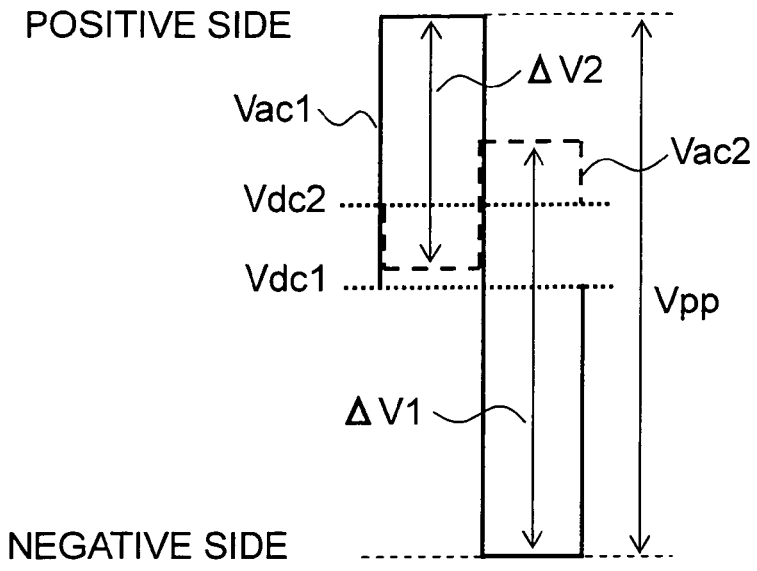
FIGS. 4A and 4B are diagrams showing the relationship between direct-current biases and alternating-current biases applied to the magnetic roller and the development roller when the alternating-current bias having an opposite phase is applied to the magnetic roller.

A description is given of how the carrier development is prevented in a case where the second alternating-current bias is not applied to the magnetic roller 22. A description will now be given of a case where the second alternating-current bias in opposite phase to the first alternating-current bias applied to the development roller 23 is applied to the magnetic roller 22. As shown in FIG. 4A, a supply bias obtained by superimposing the second alternating-current bias Vac2 in opposite phase to the first alternating-current bias Vac1 on the second direct-current bias Vdc2 is previously applied to the magnetic roller 22, and thus the potential differences ΔV1 and ΔV2 can be increased without increased peak-to-peak value Vpp as compared with the case of FIG. 3A. Hence, it is possible to smoothly replace toner on the development roller 23.

Figure 4B:
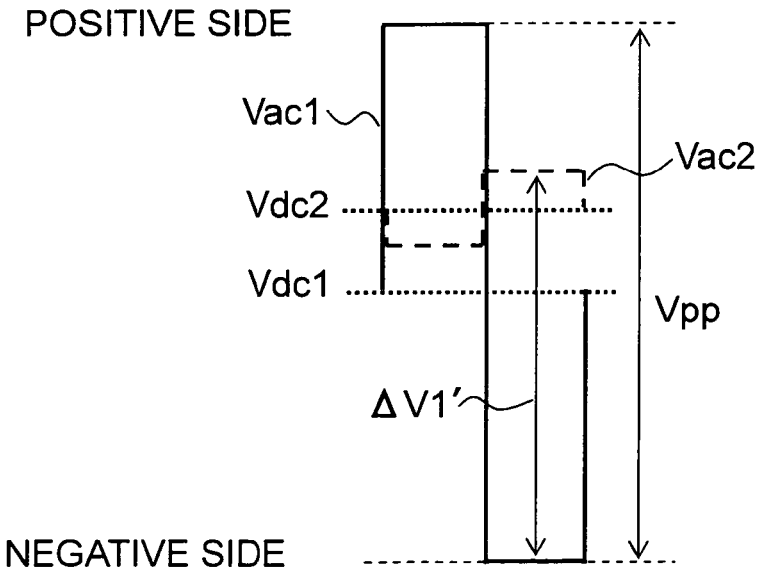

Even in this case, a hot and humid environment or prolonged driving of the development device causes the carrier development, in which the carrier is moved to the photoconductor drum 1 through the development roller 23. To overcome this problem, as shown in FIG. 4B, the peak-to-peak value Vpp of the first alternating-current bias Vac1 remains the same, and the peak-to-peak value of the second alternating-current bias Vac2 is set at a predetermined value or below. In this way, the potential difference ΔV1 decreases to the potential difference ΔV1'. Thus, as in the case of FIG. 3B, it is possible to effectively prevent the carrier development without degrading the development performance while maintaining the thickness of the thin toner layer T.

Since the likelihood of the carrier development depends on the environment in which the image forming apparatus is used, whether the second alternating-current bias Vac2 needs to be applied to the magnetic roller 22 and the peak-to-peak value of the second alternating-current bias Vac2 applied are preferably determined based on the temperature inside the apparatus and the humidity inside or outside the apparatus. This makes it possible to automatically control the second alternating-current bias Vac2 by detecting the conditions in which the carrier development is more likely to occur. Hence, it is possible to eliminate the need to manually set the second alternating-current bias Vac2, and thus avoid erroneous setting and failure to set it.

Figure 5:
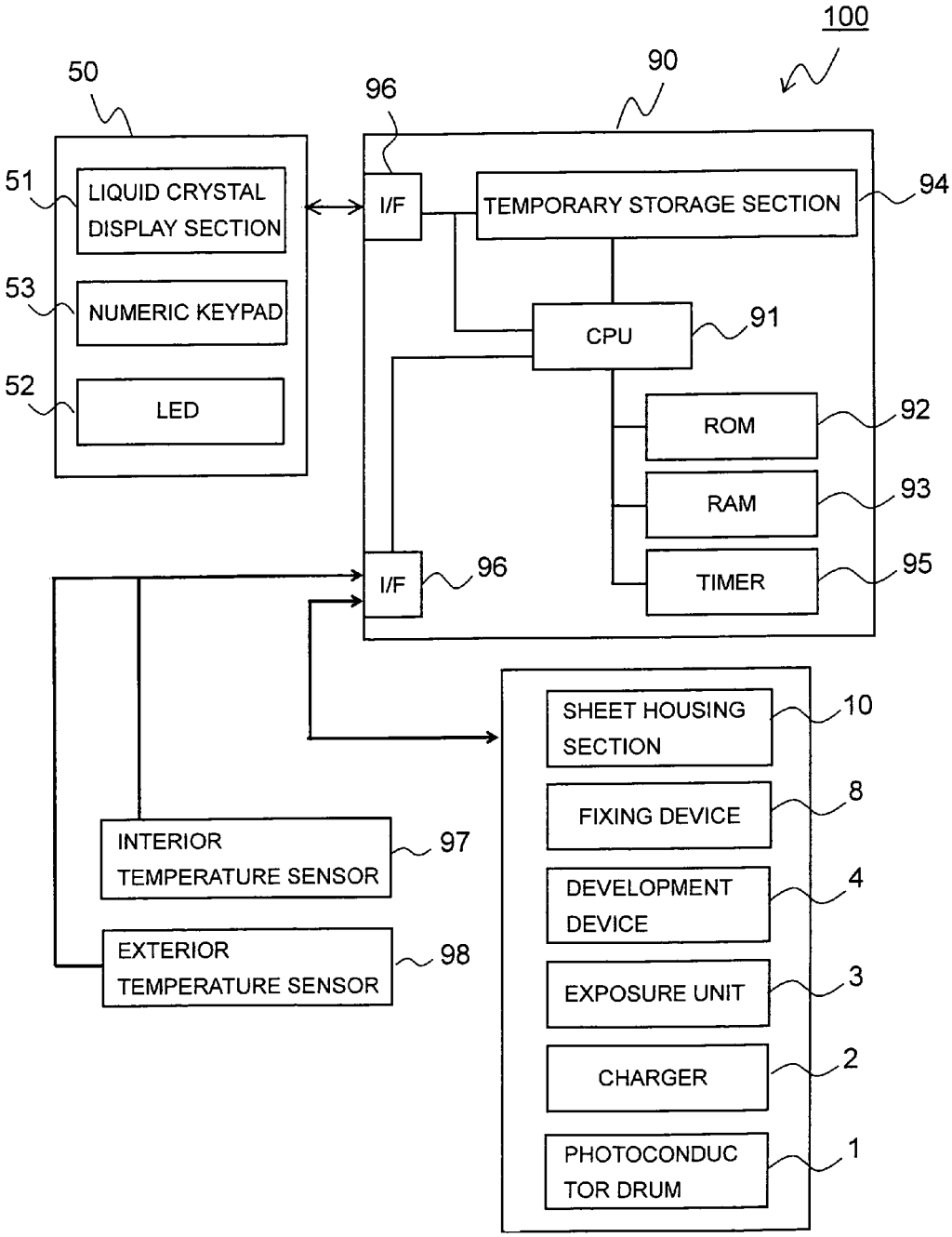
FIG. 5 is a block diagram showing a control path of the image forming apparatus.

A description will now be given of a control path of the image forming apparatus of the present invention. FIG. 5 is a block diagram showing an example of the control path used in the image forming apparatus of the invention. When the image forming apparatus 100 is in use, various controls are performed in different portions of the apparatus, and thus the overall control path of the image forming apparatus 100 is complicated. For this reason, part of such control path necessary to practice the invention will be particularly described in detail.

A control section 90 includes at least a CPU (central processing unit) 91, a ROM (read only memory) 92 serving as a storage section in which reading is only performed, a RAM (random access memory) 93 serving as a storage section in which reading and writing are freely performed, a temporary storage section 94 temporarily storing image data and the like, a timer 95 and a plurality of (here, two) I/Fs (interfaces) 96 via which control signals are transmitted to different sections in the image forming apparatus 100 and an input signal is received from an operation section 50. The control section 90 may be disposed at any position in the image forming apparatus.

In the ROM 92, programs for controlling the image forming apparatus 100 and figures and the like necessary for control are stored, that is, data and the like that are not modified when the image forming apparatus 100 is in use are stored. In the RAM 93, necessary data that is generated while the image forming apparatus 100 is controlled and data and the like that are temporally needed for controlling the image forming apparatus 100 are stored. In the ROM 92 (or the RAM 93), an environment correction table is included where temperature inside the apparatus, humidity outside the apparatus and the peak-to-peak value of the second alternating-current bias Vac2 are stored in an organized manner.

The control section 90 feeds control signals from the CPU 91 to the different portions and sections of the image forming apparatus 100 via the I/Fs 96. The different portions and sections feed signals indicating their status and input signals to the CPU 91 via the I/Fs 96. The different portions and sections controlled by the control section 90 include the photoconductor drum 1, the charger 2, the exposure unit 3, the development device 4, a fixing device 8, the sheet housing section 10 and the operation section 50.

The operation section 50 is provided with a liquid crystal display section 51, LEDs 52 indicating various conditions and a numeric keypad 53; a user operates the operation section 50 to input instructions and thereby makes various settings of the image forming apparatus 100 to perform various operations such as image formation. The liquid crystal display section 51 indicates the condition of the image forming apparatus 100 and displays the status of image formation and the number of printed sheets. The liquid crystal display section 51 is used as a touch panel to make the following various settings: operational settings such as for double-sided printing and for reversing black and white, scale settings, density settings and other settings. The numeric keypad 53 is used such as for setting the number of printed sheets and for inputting the fax numbers of destinations when the image forming apparatus 100 has facsimile capability.

In addition, the operation section 50 is provided with: a start button used when the user instructs the image forming apparatus 100 to start image formation; a stop/clear button used when the image formation is stopped or other operations are performed; a reset button used when various settings of the image forming apparatus 100 are reset to default settings; and the like.

An interior temperature sensor 97 detects temperature inside the apparatus and particularly temperature on the surface of or around the photoconductor drum 1; it is disposed near the photoconductor drum 1. An exterior humidity sensor 98 detects humidity outside the apparatus; it is disposed near, for example, an intake air duct (unillustrated) on the side of the sheet housing section 10 shown in FIG. 1, which is less likely to be affected by heating portions, but may be disposed at any other position where the humidity outside the apparatus can be detected accurately.

The interior temperature sensor 97 and the exterior humidity sensor 98 constantly detect temperature inside the apparatus and humidity outside the apparatus at predetermined time intervals. When the operation section 50 gives an instruction of image output to the CPU 91, information of temperature inside the apparatus and humidity outside the apparatus detected by the interior temperature sensor 97 and the exterior humidity sensor 98 is fed to the CPU 91 via the I/F 96, and whether the second alternating-current bias Vac2 needs to be controlled is determined using the information of temperature inside the apparatus and humidity outside the apparatus and the environment correction table. If it is necessary to control the second alternating-current bias Vac2, an appropriate peak-to-peak value of the second alternating-current bias Vac2 is selected, and the information of such a value is outputted to the CPU 91.

In this way, it is possible to determine whether to control the second alternating-current bias Vac2 based on the results of detection by the interior temperature sensor 97 and the exterior humidity sensor 98. Thus, in hot and humid conditions where the carrier development is more likely to occur, the occurrence of the carrier development can be prevented by controlling the second alternating-current bias Vac2; in conditions where no carrier development occurs, unnecessary control can be avoided. Preferably, if possible, the second alternating-current bias Vac2 is controlled by use of the information of temperature and humidity detected immediately before the start of the control. However, the information of temperature and humidity detected at any other timing may be used to control the second alternating-current bias Vac2. Temperature and humidity is detected a predetermined number of times, and the average of the detected values may be used.

Even when whether the second alternating-current bias Vac2 needs to be controlled and the peak-to-peak value for the control are determined according to the accumulated drive time of the development device, exactly the same procedure is followed. Specifically, the accumulated drive time of the development device is measured by the timer 95, and the correction table that links the accumulated drive time and the peak-to-peak value of the second alternating-current bias Vac2 is stored in the ROM 92 (or the RAM 93). Then, based on the accumulated drive time measured, whether the second alternating-current bias Vac2 needs to be controlled and the peak-to-peak value are determined.

The present invention is not limited to the embodiments described above, and many modifications and variations are possible without departing from the spirit of the invention. For example, although the embodiments described above deal with a case where the development device uses toner that is positively charged, the invention can equally be applied to a development device using toner that is negatively charged. In this case, although toner is supplied to the development roller 23 when voltage is on the positive side of the alternating-current waveform and the toner is recovered from the development roller 23 when voltage is on the negative side of the alternating-current waveform, the effects obtained by applying the second alternating-current bias Vac2 to the magnetic roller 22 are the same as those obtained by the use of the positively charged toner. There is no need to keep constant the peak-to-peak value Vpp of the first alternating-current bias Vac1 in a precise manner, and thus the peak-to-peak value Vpp is maintained at a predetermined value or above at which the development performance on an electrostatic latent image on the photoconductor drum is maintained.

In addition to the monochrome printer shown in FIG. 1, the present invention can be applied to various image forming apparatuses incorporating a development device employing a touchdown development method, such as digital and analog monochrome copying machines, tandem-type and rotary-development-type color printers and color copying machines and facsimile machines. Hereinafter, the benefits of the present invention will be described in further detail by way of examples.

diameter of 16 mm, were used. With respect to the conditions of development, the linear velocities of the photoconductor drum, the development roller and the magnetic roller were set at 84 mm/sec., 126 mm/sec. and 189 mm/sec., respectively, a 200 μm gap was left between the drum and the development roller and a 350 μm gap was left between the development roller and the magnetic roller. With respect to the developer, a two-component developer (where a mixing ratio of toner to carrier was 8.0% by weight) composed of positively charged toner and a Mn—Mg based carrier was used.

The following evaluation method was used. While the first direct-current bias Vdc1 applied to the development roller and the second direct-current bias Vdc2 applied to the magnetic roller were set at 100 V and 300 V, respectively and the peak-to-peak values (Vpp1 and Vpp2) of the first alternating-current bias Vac1 and the second alternating-current bias Vac2 were varied, entire solid images were printed. Then, the number of carriers developed was counted visually. The invisible carriers were omitted from the counting. For the evaluation of consistency in image density, inconsistencies in density repeatedly appearing in a solid image per rotation of the roller were checked.

The following criteria were used for the evaluation of consistency in image density: when no inconsistencies in density repeatedly appearing in a solid image were observed, the result is indicated by "good (acceptable)"; when inconsistencies in density repeatedly appearing in a solid image were observed but no white spots were observed, the result is indicated by "fair (unacceptable)"; and when inconsistencies in density repeatedly appearing in a solid image were remarkably observed and white spots were also observed, the result is indicated by "poor (unacceptable)". The result of the evaluation is shown in Table 1.

TABLE 1

| | | Test example 1 | Test example 2 | Test example 3 | Test example 4 | Test example 5 |
|---|---|---|---|---|---|---|
| Development bias | Vpp1 | 1.6 kV | 1.6 kV | 1.6 kV | 1.4 kV | 1.2 kV |
| | Vdc1 | 100 V | 100 V | 100 V | 100 V | 100 V |
| | +Vpp1 | 900 V | 900 V | 900 V | 800 V | 700 V |
| | −Vpp1 | −700 V | −700 V | −700 V | −600 V | −500 V |
| Supply bias | Vpp2 | 200 V | 400 V | 600 V | 200 V | 200 V |
| | Vdc2 | 300 V | 300 V | 300 V | 300 V | 300 V |
| | +Vpp2 | 400 V | 500 V | 600 V | 400 V | 400 V |
| | −Vpp2 | 200 V | 100 V | 0 V | 200 V | 200 V |
| The potential difference ΔV1 between negative peak voltages = \|(−Vpp1) − (−Vpp2)\| | | 900 V | 800 V | 700 V | 800 V | 700 V |
| The number of carriers developed | | 26 | 2 | 0 | 3 | 0 |
| Consistency in image density | | Good (acceptable) | Good (acceptable) | Good (acceptable) | Fair (unacceptable) | Poor (unacceptable) |

Example 1

With a test machine ("FS-C5016N" made by "Kyocera Mita Corporation") incorporating the development device shown in FIG. 2 and according to the present invention, restrictive effects on the carrier development when images were printed were examined in a case where the second alternating-current bias Vac2 in phase with the first alternating-current bias Vac1 applied to the development roller 23 was applied to the magnetic roller 22 as shown in FIG. 3B.

With respect to the test machine, an amorphous silicon photoconductor drum having a diameter of 30 mm was used, and the potential on the surface of the drum was set at 350 V and the light potential of the drum was set at 30 V; the development roller and the magnetic roller, each having a As will be apparent from Table 1, in test example 1, where the peak-to-peak value Vpp1 of the first alternating-current bias Vac1 was set at 1.6 kV and the peak-to-peak value Vpp2 of the second alternating-current bias Vac2 was set at 200 V, consistency in image density was excellent but since the potential difference ΔV1 between the negative peak voltages that affects the supply of toner to the development roller (the removal of toner from the magnetic roller) was as high as 900 V, 26 carriers were developed in the image.

In contrast, in test example 2, where the peak-to-peak value Vpp2 of the second alternating-current bias Vac2 was set at 400 V and the potential difference ΔV1 was set at as low as 800 V, as few as two carries were developed in the image, and consistency in image density was excellent. In test example 3, where the peak-to-peak value Vpp2 of the second alternating-current bias Vac2 was set at 600 V and the potential difference ΔV1 was set at as low as 700 V, no carries were observed visually in the image and better restrictive effects on the carrier development were obtained.

In test examples 4 and 5, where the peak-to-peak values Vpp2 of the second alternating-current bias Vac2 were maintained at 200 V and the peak-to-peak values Vpp1 of the first alternating-current bias Vac1 were set at 1.4 kV and 1.2 kV, respectively, as in test examples 2 and 3, since the potential differences ΔV1 were reduced to 800 V and 700 V, respectively, the carrier development was prevented, but since the peak-to-peak values Vpp1 were reduced, the development performance was degraded and inconsistencies in density repeatedly appearing in the images were observed.

These results show that the peak-to-peak value Vpp1 of the first alternating-current bias Vac1 is maintained at a predetermined value (here, 1.6 kV) and the potential difference ΔV1 between the negative peak voltages is set at a predetermined value (here, 800 V) or below, and thus it is possible to prevent the carrier development without degrading development performance.

Since example 1 described above is simply an example of the present invention, the first direct-current bias Vdc1 and the first alternating-current bias Vac1 applied to the development roller and the second direct-current bias Vdc2 and the second alternating-current bias Vac2 applied to the magnetic roller may be appropriately set according to the specifications and usage environment of the apparatus. Although no detailed description is given herein, the same benefits were obtained when the second alternating-current bias Vac2 in opposite phase to the first alternating-current bias Vac1 was applied to the magnetic roller as shown in FIGS. 4A and 4B According to the present invention, a development device using a two-component developer containing at least a carrier and toner is provided that includes: a toner carrying member that is disposed opposite an image carrying member and that adheres, by receiving a development bias composed of a first direct-current bias and a first alternating-current bias, toner to the surface of the image carrying member to develop an electrostatic latent image; and a toner supply member receiving a supply bias composed of a second direct-current bias higher on the same polarity side as the polarity of the toner than the first direct-current bias and a second alternating-current bias having a peak-to-peak value lower than that of the first alternating-current bias and forming with a magnetic brush a thin toner layer on the toner carrying member. Here, a potential difference between a peak voltage of the development bias on the opposite polarity side to the polarity of the toner and a peak voltage of the supply bias is set at a predetermined value or below.

With this development device, when the toner is supplied to the toner carrying member, the toner is not removed more than necessary, and this prevents the carrier on the toner supply member from having the opposite charges. Thus, it is possible to effectively prevent the carrier from moving to the toner carrying member. This makes it possible to provide a development device that causes no carrier development. Here, a potential difference between the first direct-current bias and the second direct-current bias remains unchanged, and the potential difference between the peak voltages of the development bias and the supply bias on the opposite polarity side to the polarity of the toner is set at a predetermined value or below. In this way, it is possible to keep constant the thickness of a thin toner layer formed on the toner carrying member.

Generally, the peak-to-peak value of the first alternating-current bias remains unchanged, and the second alternating-current bias that is in phase with the first alternating-current bias and that has a peak-to-peak value of a predetermined value or above is applied to the toner supply member. When the second alternating-current bias in opposite phase to the first alternating-current bias is previously applied to the toner supply member, the peak-to-peak value of the second alternating-current bias is set at a predetermined value or below. Thus, since the development performance on an electrostatic latent image on the image carrying member is maintained, a development device is provided that prevents the carrier development effectively and that has no inconsistencies in development density and has great consistency in image density.

An image forming apparatus is provided with a development device according to the present invention in which whether the second alternating-current bias needs to be applied and a peak-to-peak value are determined according to temperature and humidity detected or the accumulated drive time of the development device. Thus, even in conditions where the carrier development is more likely to occur, with the image forming apparatus described above, it is possible to further effectively prevent the occurrence of the carrier development by applying a predetermined second alternating-current bias corresponding to the conditions, and thus form high-quality images.

What is claimed is:

1. A development device comprising:

a toner carrying member that is disposed opposite an image carrying member and that adheres, by receiving a development bias composed of a first direct-current bias and a first alternating-current bias, toner to a surface of the image carrying member to develop an electrostatic latent image; and a toner supply member receiving a supply bias composed of a second direct-current bias higher on a same polarity side as a polarity of the toner than the first direct-current bias and a second alternating-current bias having a peak-to-peak value lower than a peak-to-peak value of the first alternating-current bias and forming with a magnetic brush a thin toner layer on the toner carrying member, wherein a potential difference between a peak voltage of the development bias on an opposite polarity side to the polarity of the toner and a peak voltage of the supply bias is set at a predetermined value or below, and a two-component developer including at least a carrier and the toner is used.

2. The development device of claim 1, wherein a potential difference between the first direct-current bias and the second direct-current bias remains unchanged, and the potential difference between the peak voltage of the development bias on the opposite polarity side to the polarity of the toner and the peak voltage of the supply bias is set at a predetermined value or below.

3. The development device of claim 2, wherein the peak-to-peak value of the first alternating-current bias is maintained at a predetermined value or above, and the potential difference between the peak voltage of the development bias on the opposite polarity side to the polarity of the toner and the peak voltage of the supply bias is set at a predetermined value or below.

4. The development device of claim 3, wherein when the second alternating-current bias in phase with the first alternating-current bias is applied to the toner supply member, the peak-to-peak value of the first alternating-current bias remains unchanged, and the peak-to-peak value of the second alternating-current bias is set at a predetermined value or above.

5. The development device of claim 3, wherein when the second alternating-current bias in opposite phase to the first alternating-current bias is applied to the toner supply member, the peak-to-peak value of the first alternating-current bias remains unchanged, and the peak-to-peak value of the second alternating-current bias is set at a predetermined value or below.

6. An image forming apparatus comprising:

the development device of claim 1; a temperature detection device detecting a temperature inside the image forming apparatus;

a humidity detection device detecting a humidity inside or outside the image forming apparatus; and a control device determining, according to the temperature and the humidity detected by the temperature detection device and the humidity detection device, whether the second alternating-current bias needs to be applied and the peak-to-peak value of the second alternating-current bias applied.

7. An image forming apparatus comprising:

the development device of claim 2; a temperature detection device detecting a temperature inside the image forming apparatus;

a humidity detection device detecting a humidity inside or outside the image forming apparatus; and a control device determining, according to the temperature and the humidity detected by the temperature detection device and the humidity detection device, whether the second alternating-current bias needs to be applied and the peak-to-peak value of the second alternating-current bias applied.

8. An image forming apparatus comprising:

the development device of claim 3; a temperature detection device detecting a temperature inside the image forming apparatus;

a humidity detection device detecting a humidity inside or outside the image forming apparatus; and a control device determining, according to the temperature and the humidity detected by the temperature detection device and the humidity detection device, whether the second alternating-current bias needs to be applied and the peak-to-peak value of the second alternating-current bias applied.

9. An image forming apparatus comprising:

the development device of claim 4; a temperature detection device detecting a temperature inside the image forming apparatus;

a humidity detection device detecting a humidity inside or outside the image forming apparatus; and a control device determining, according to the temperature and the humidity detected by the temperature detection device and the humidity detection device, whether the second alternating-current bias needs to be applied and the peak-to-peak value of the second alternating-current bias applied.

10. An image forming apparatus comprising:

the development device of claim 5; a temperature detection device detecting a temperature inside the image forming apparatus;

a humidity detection device detecting a humidity inside or outside the image forming apparatus; and a control device determining, according to the temperature and the humidity detected by the temperature detection device and the humidity detection device, whether the second alternating-current bias needs to be applied and the peak-to-peak value of the second alternating-current bias applied.

11. An image forming apparatus comprising:

the development device of claim 1; a measuring device measuring an accumulated drive time of the development device; and a control device determining, according to the accumulated drive time measured by the measuring device, whether the second alternating-current bias needs to be applied and the peak-to-peak value of the second alternating-current bias applied.

12. An image forming apparatus comprising:

the development device of claim 2; a measuring device measuring an accumulated drive time of the development device; and a control device determining, according to the accumulated drive time measured by the measuring device, whether the second alternating-current bias needs to be applied and the peak-to-peak value of the second alternating-current bias applied.

13. An image forming apparatus comprising:

the development device of claim 3; a measuring device measuring an accumulated drive time of the development device; and a control device determining, according to the accumulated drive time measured by the measuring device, whether the second alternating-current bias needs to be applied and the peak-to-peak value of the second alternating-current bias applied.

14. An image forming apparatus comprising:

the development device of claim 4; a measuring device measuring an accumulated drive time of the development device; and a control device determining, according to the accumulated drive time measured by the measuring device, whether the second alternating-current bias needs to be applied and the peak-to-peak value of the second alternating-current bias applied.

15. An image forming apparatus comprising:

the development device of claim 5; a measuring device measuring an accumulated drive time of the development device; and a control device determining, according to the accumulated drive time measured by the measuring device, whether the second alternating-current bias needs to be applied and the peak-to-peak value of the second alternating-current bias applied.

* * * * *